US008490794B2

(12) United States Patent
Kälin et al.

(10) Patent No.: US 8,490,794 B2
(45) Date of Patent: Jul. 23, 2013

(54) PACK

(75) Inventors: Alfred Kälin, Rheinfelden (CH); Martin Krause, Blotzheim (FR)

(73) Assignee: Rondo AG, Allschwil (CH)

( * ) Notice: Subject to any disclaimer, the term of this patent is extended or adjusted under 35 U.S.C. 154(b) by 28 days.

(21) Appl. No.: 12/982,149

(22) Filed: Dec. 30, 2010

(65) Prior Publication Data

US 2011/0163155 A1 Jul. 7, 2011

(30) Foreign Application Priority Data

Jan. 5, 2010 (EP) ..... 10150109

(51) Int. Cl.
*B65D 83/04* (2006.01)

(52) U.S. Cl.
USPC ..... 206/528; 206/532; 206/468

(58) Field of Classification Search
USPC ..... 206/532, 531, 528, 534, 536, 535, 206/538, 1.5, 468, 461; 229/212, 210, 207, 229/200
See application file for complete search history.

(56) References Cited

U.S. PATENT DOCUMENTS

| | | | | | |
|---|---|---|---|---|---|
| 1,984,351 | A | * | 12/1934 | Johnson | 206/531 |
| 3,885,732 | A | * | 5/1975 | Foster | 229/208 |
| 4,120,400 | A | * | 10/1978 | Kotyuk | 206/528 |
| 4,192,422 | A | | 3/1980 | Kotyuk | |
| 4,817,819 | A | * | 4/1989 | Kelly | 221/2 |
| 4,911,304 | A | * | 3/1990 | Bunin | 206/531 |
| 4,989,730 | A | * | 2/1991 | Lemoine | 206/362 |
| 5,150,793 | A | * | 9/1992 | Tannenbaum | 206/531 |
| 5,579,910 | A | * | 12/1996 | Bennett | 206/362 |
| 6,230,893 | B1 | * | 5/2001 | Karow | 206/531 |
| 6,412,636 | B1 | * | 7/2002 | Jones et al. | 206/532 |
| 6,491,211 | B1 | * | 12/2002 | Evans et al. | 229/102 |
| 6,641,031 | B2 | * | 11/2003 | Evans et al. | 229/102 |
| 6,776,288 | B2 | * | 8/2004 | Kopecky | 206/538 |
| 6,874,636 | B2 | * | 4/2005 | Paliotta et al. | 206/531 |
| 7,389,875 | B2 | * | 6/2008 | Sandberg et al. | 206/531 |
| 7,735,650 | B2 | * | 6/2010 | Zumbiel | 206/532 |
| 7,798,329 | B2 | * | 9/2010 | Gelardi | 206/531 |
| 7,810,640 | B2 | * | 10/2010 | Weston | 206/485 |
| 7,845,496 | B2 | * | 12/2010 | Hession | 206/538 |
| 8,011,512 | B2 | * | 9/2011 | Brollier et al. | 206/531 |

(Continued)

FOREIGN PATENT DOCUMENTS

| | | | |
|---|---|---|---|
| DE | 20 2008 009 673 | U1 | 12/2009 |
| EP | 1 700 797 | A1 | 9/2006 |
| WO | 2007/030563 | A1 | 3/2007 |
| WO | 2008/079091 | A1 | 7/2008 |

*Primary Examiner* — Steven A. Reynolds
(74) *Attorney, Agent, or Firm* — Nath, Goldberg & Meyer; Jerald L. Meyer

(57) ABSTRACT

A pack (1) has a basic body (2) and a carrier (3) which is mounted in a displaceable manner therein and is intended for blisters or the like. The basic body (2) is of two-part design and comprises a floor part (5) made of cardboard and a moulding (6) made of plastics material. For childproofing purposes, the blister carrier (3) has a latching tongue (11), which is articulated in a resilient manner on a base portion (13), and the basic body (2) has a housing wall with a latching shoulder (10), wherein the latching shoulder (10) interacts with the latching tongue (11) in order to create a latching connection in the rest position. The latching shoulder (10) is formed here by a step in the housing wall in the region of the upper side.

18 Claims, 5 Drawing Sheets

U.S. PATENT DOCUMENTS

Figure 1:
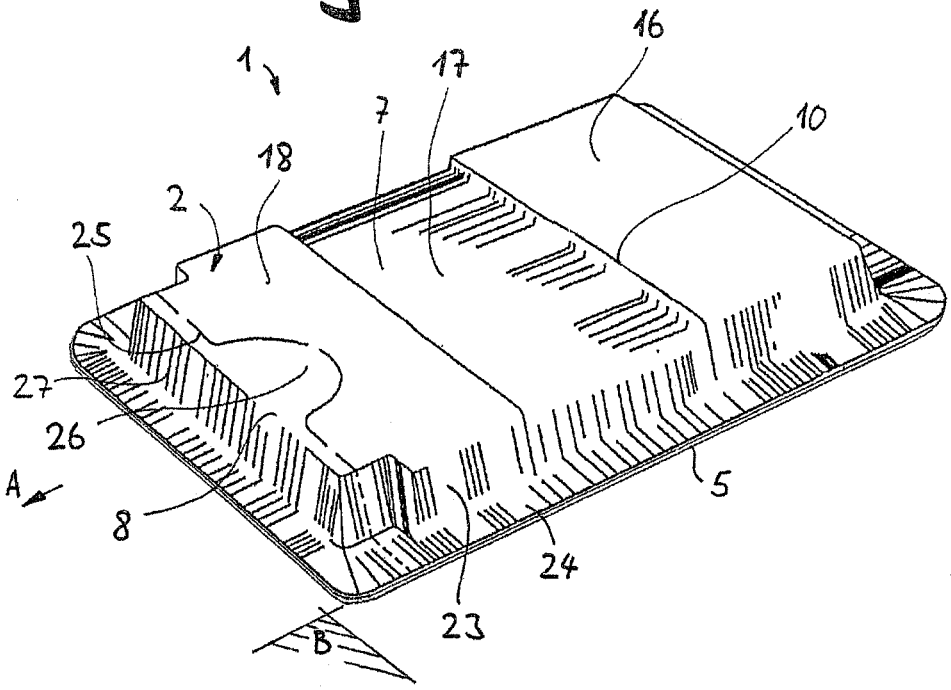

2003/0080021 A1* 5/2003 Kopecky ..... 206/531
2003/0085262 A1* 5/2003 Evans et al. ..... 229/102
2003/0116614 A1* 6/2003 Block et al. ..... 229/146
2004/0050748 A1* 3/2004 Ehrlund ..... 206/538
2004/0188311 A1* 9/2004 Paliotta et al. ..... 206/531
2004/0232033 A1* 11/2004 Paliotta et al. ..... 206/531
2006/0151346 A1* 7/2006 Cho ..... 206/362
2007/0045149 A1* 3/2007 Hession ..... 206/538
2008/0217205 A1* 9/2008 Sattel et al. ..... 206/531
2008/0257773 A1* 10/2008 Gelardi ..... 206/462
2008/0283434 A1* 11/2008 Gelardi ..... 206/468
2009/0045096 A1* 2/2009 Knutson et al. ..... 206/570
2009/0184023 A1* 7/2009 Brollier et al. ..... 206/531
2009/0301924 A1* 12/2009 Rondeau ..... 206/531
2010/0038278 A1* 2/2010 Gattefosse et al. ..... 206/531
2010/0230320 A1* 9/2010 Caron et al. ..... 206/531
2010/0243509 A1* 9/2010 Gelardi ..... 206/536
2010/0300923 A1* 12/2010 Sack et al. ..... 206/531
2011/0068039 A1* 3/2011 Sack et al. ..... 206/531
2012/0037517 A1* 2/2012 Grosskopf ..... 206/1.5

* cited by examiner

PACK

The invention relates to a pack according to the preamble of claim 1. The pack comprises essentially a basic body which is produced preferably from a blank and in the hollow of which a carrier is mounted in a displaceable manner. The carrier may be, for example, a blister carrier for accommodating at least one blister or a carrier for other objects. Such blisters serve, for example, for packaging pharmaceutical products, such as tablets or capsules, and have been known, and in common use, for some time now. Packs with pull-out blister carriers are also known, and familiar, to a person skilled in the art as "slide packs". The slide pack, for childproofing purposes, has securing means which are intended to ensure that children can open them only with difficulty, if at all.

A slide pack has been disclosed, for example, in WO 2006/068602 A1. The pack in this latter document has a basic body which is produced from a blank and in the hollow of which a blister carrier or some other insert is arranged such that it can be displaced to a limited extent. As securing means for childproofing purposes, the pack has blocking portions which are articulated on the basic-body blank and, when the basic body is in the finished, parallelepipedal state, form a hollow profile which serves as a stop for a blocking lug arranged on the blister carrier. The childproofing means (or blocking position) can be disabled by virtue of pressure being applied to a knob-like lug which is arranged on an upper side of the hollow body and is predetermined by a circular cutting line. The complicated configuration of the childproofing means results in the pack being relatively difficult to produce. It is further disadvantageous that material-related outlay is extremely high. A further disadvantage of this cardboard pack, which is produced exclusively by cutting, folding and adhesive-bonding operations, resides in the fact that it is not particularly stable and soon shows signs of wear after being used a number of times. It is also the case that the pack cannot meet relatively stringent requirements in respect of childproofing. For instance, it has been found that children can open the pack relatively easily. The opening predetermined by the knob-like lug allows the upper side of the pack to be torn open easily and the blister then to be removed.

It is therefore an object of the present invention to avoid the disadvantages of the known pack and to create in particular a pack which, on the one hand, meets stringent requirements in respect of childproofing and, on the other hand, is cost-effective and straightforward to produce.

These objects are achieved by a pack having the features of Claim 1. The carrier has a latching tongue which is articulated in a resilient manner on a base portion. A housing wall of the basic body has a latching shoulder, wherein the latching shoulder interacts with the latching tongue in order to create a latching connection in the rest position or blocking position. The latching tongue may have a front edge, which is, or can be, supported on the latching shoulder and thus brings about locking, such that pulling cannot take place, in the rest position. The securing means are preferably configured such that, for example following initial opening or movement into the removal position, the carrier can be latched into the basic body when it is pushed back. If a user tries to pull the latched-in carrier (rest position) out of the basic body, then the latching tongue strikes against the latching shoulder, as a result of which the carrier is prevented from being pulled out of the rest position. It is only once the user uses the specific application of force to disable the engagement between the latching tongue and latching shoulder that the carrier can be pulled out. Movement takes place here in a longitudinal direction.

The carrier may be configured as a blister carrier, wherein one or more blisters can be fastened on the base portion. The base portion and latching tongue may be formed from a single blank made of cardboard or cardboard laminate. It is possible for at least one blister to lie flat on the base portion and to be fastened, or fastenable, thereon. The base portion can run in an approximately plane-parallel manner in relation to a floor plane. The term "blister" is understood hereinbelow to be a packaging unit which contains a base sheet, provided with at least one cavity for accommodating pack contents, and a cavity-covering, pressure-sensitive cover sheet. For removal of the pack contents, the latter are pushed through the cover sheet, which consists, for example, of aluminium. Single blisters are also known as "blister strips".

In a first embodiment, the latching shoulder may be arranged on an upper side which is located opposite the carrier and preferably extends essentially in an approximately plane-parallel manner in relation to a floor plane. Of course, the upper side must not be oriented in a precisely plane-parallel manner in relation to the floor plane. The upper side may also be inclined in relation to the floor plane. It is also conceivable for individual wall portions of the upper side to be curved. Furthermore, the upper side may comprise a plurality of wall portions with different spacings between them and the floor plane.

As an alternative, it would also be conceivable for the latching shoulder to be provided on a housing wall which projects away from the floor plane. In this case, the latching shoulder could be assigned to a longitudinally extending housing wall which will be referred to hereinbelow as a "longitudinal side wall".

In a preferred embodiment, the latching shoulder may be formed by a step in the housing wall. The step may form a transition between two housing-wall portions. This step may be arranged on the aforementioned upper side or, if need be, on the longitudinal side wall of the basic body. Such a step may be connected integrally to the adjacent housing-wall portions. There is therefore no need for folding or adhesive-bonding operations for forming a blocking stop. The step is thus, as it were, integrated in the housing wall and can be created by appropriate shaping of a sheet-like material. The step forms, with the adjacent housing-wall portions, a continuous profile contour with constant or variable wall thickness.

In a further embodiment, the basic body or the hollow body of the basic body may have a latching-tongue-accommodating region for accommodating the latching tongue in the rest position. The latching-tongue-accommodating region may be followed, in the direction of the opening, by a carrier-accommodating region, wherein the latching shoulder is located in the transition region between the latching-tongue-accommodating region and carrier-accommodating region. In the case of a blister pack, the carrier-accommodating region may be a cavity-accommodating region in which the cavities of the blister can be accommodated.

It may be advantageous if the carrier-accommodating region is followed by an end region which predetermines the opening and is intended for accommodating a preferably U-shaped deflection of the carrier, wherein a housing-wall portion which is assigned to the end region is elevated in relation to a housing-wall portion which is assigned to the cavity-accommodating region. The housing-wall portion assigned to the end region may run in an approximately plane-parallel manner in relation to the floor plane. The deflection may be formed by an articulation strip, which follows the base portion, and by a further portion, wherein the further portion has a free end edge.

The housing-wall portion which is assigned to the carrier-accommodating region and a housing-wall portion which is assigned to the latching-tongue-accommodating region may run in an approximately plane-parallel manner in relation to the floor plane. The spacing between the respective planes predetermines the height of the latching shoulder. This allows a step-like construction of the housing wall to be created in a particularly straightforward manner.

The carrier may comprise a single blank made of cardboard or cardboard laminate. For special pack solutions, however, plastics materials would also be conceivable.

The base portion and the latching tongue may be separated from one another by folding lines. An articulation strip may be arranged between the base portion and latching tongue. At least in the rest position, the base portion, articulation strip and latching tongue can define a U shape in side view. Such a blank is particularly straightforward and cost-effective to produce.

An advantageous childproofing means can be created if the housing wall can be pushed inwards in the latching-tongue-accommodating region in order to release the latching connection by elastic deformation and without any further weakening. Such a configuration can also ensure that children find it very difficult to destroy the pack, if indeed they can do so at all, in order to bypass the childproofing means.

The basic body may have longitudinal side walls extending in the displacement direction or longitudinal direction, wherein, in order to delimit the displacement movement when the carrier is being pulled out, the side walls may have a tapered portion which forms a stop for the latching tongue and/or other blocking means. This tapered portion can form a blocking shoulder for predetermining the stop.

As an alternative, or in addition, the base portion may be adjoined in each case by laterally articulated blocking segments which, when the carrier is being pulled out, can be made to strike against the tapered portion or against the blocking shoulders. The blocking segments may be arranged in a resilient manner on the base portion such that, when the carrier is being pulled out, they can be moved, preferably with a friction fit, along the side walls of the basic body. The blocking means, however, may also be in the form of sheet-like blocking means which are formed on the base portion and are located in the same plane.

In a particularly preferred embodiment, the basic body may be of two-part design. The two-part basic body here may comprise a floor part and a moulding. Depending on the configuration of the securing means and possibly the blocking means, the pack insert has to be inserted prior to the basic body being assembled, i.e. before the moulding is fastened on the floor part. Of course, it is also conceivable, however, to have variants in which the pack insert is pushed into the basic-body hollow, and latch thereto, only after the basic body has been assembled. Such a two-part configuration of the basic body could also be advantageous for conventional childproof packs even without the previously described latching shoulder.

The floor part may be formed by a planar, sheet-like component which is located in a floor plane. Such a component is particularly straightforward to produce. A further advantage of such a sheet-like component resides in the fact that it can be connected, and preferably adhesively bonded, particularly straightforwardly to the second component of the basic body (moulding).

It may also be particularly advantageous if the hollow is predetermined only by the shaping of the moulding. The moulding may be a component which is produced by a moulding or forming operation, in particular by an injection-moulding, thermoforming or blow-moulding operation, and is preferably made of plastics material. It is particularly preferred if the moulding, in order to optimize childproofing, is produced from a non-transparent plastics material. This gives rise to a comparatively rigid single-piece component. This is because, in relation to folding packs made of cardboard, there is no need, at least in respect of the shaping, to provide any folding lines or weakening lines, and therefore the pack is distinguished by a comparatively high level of stability. The moulding has the advantage that even comparatively complicated outer and inner contours are possible for the basic body.

The moulding, for predetermining the hollow, may have a tray-like configuration enclosed by a peripheral portion. Such a configuration could be produced particularly straightforwardly and cost-effectively by means of thermoforming.

The moulding may have a peripheral portion which rests flat on the floor part and, at least in certain regions, forms an adhesive-bonding or sealing surface for connecting the floor part to the moulding. This gives rise to peripheral fixing all the way round. In particular adhesives, for example hot-melt adhesives, or so-called hot melts, are suitable for fastening the two components. It is also possible, however, to use fastening methods which are known to a person skilled in the art under the umbrella term of "sealing" (e.g. heat sealing and ultrasonic sealing). For this purpose, the peripheral portion of the moulding may be provided with a sealing layer which can be activated by subjecting it to heat or ultrasonic vibration, in which case welding or surface adhesion takes place.

The aforementioned advantages may also be achieved using other securing means for childproofing purposes. A slide pack containing a floor part, consisting of paper, cardboard or a cardboard laminate, in combination with a moulding made of plastics material, and preferably produced by injection moulding or thermoforming, could thus also form the subject matter of an invention in its own right.

In a further embodiment, finally, the end opening of the basic body may be closed by a tear-off closure predetermined by predetermined tearing lines. The closure is torn off to form the previously mentioned opening. Such a closure has the advantage that the pack contents are protected relatively reliably in relation to external influences. A further advantage of the closure solution resides in the fact that, once the closure has been torn off for the first time, it is no longer possible to recreate the original state, and this ensures a tamperproofing function.

It may be particularly advantageous if the closure comprises parts both of the floor part and of the moulding.

In the region of the end opening and/or in the end region, it is possible for a respective cutout to be arranged in the upper side of the basic body, and/or in that side of the basic body which is located opposite the upper side, in order to make it easier to grip the carrier, and this facilitates the handling of the pack. Prior to initial opening of the pack in each case, the cutout may be blocked by a detachable tongue predetermined by predetermined tearing lines. The predetermined tearing lines assigned to the tongue may form a constituent part of the predetermined tearing lines which separate the closure from the rest of the basic body. Accordingly, it is possible for the tongue to be formed on the closure and, when the closure is torn off, to be detachable, together with this closure, from the rest of the pack. The tongue may be predetermined, for example, by a semicircular predetermined tearing line.

Figure 2:
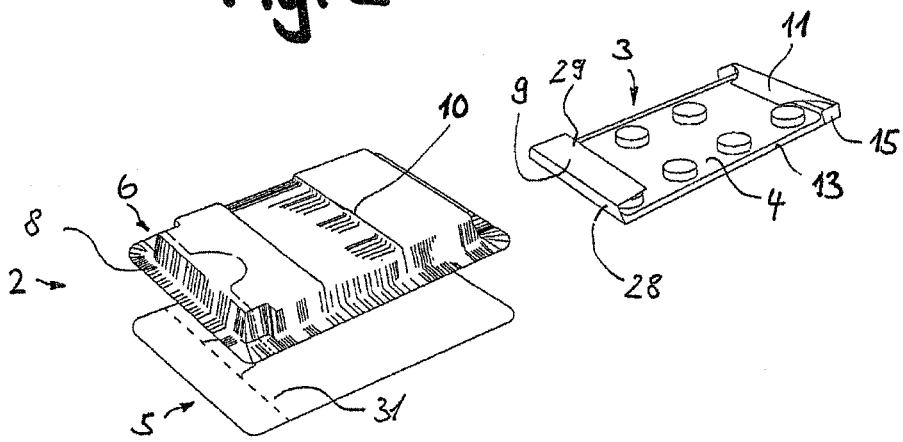
Figure 3:
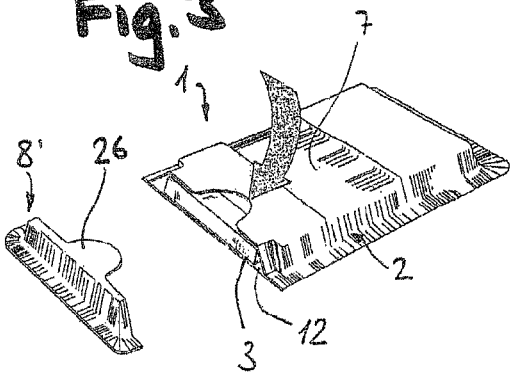
Figure 4:
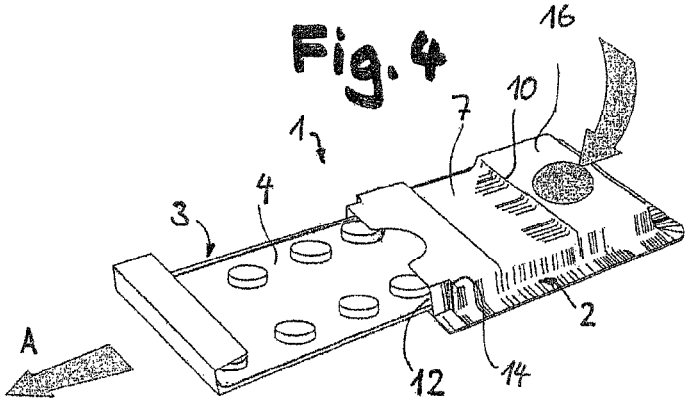
Figure 5:
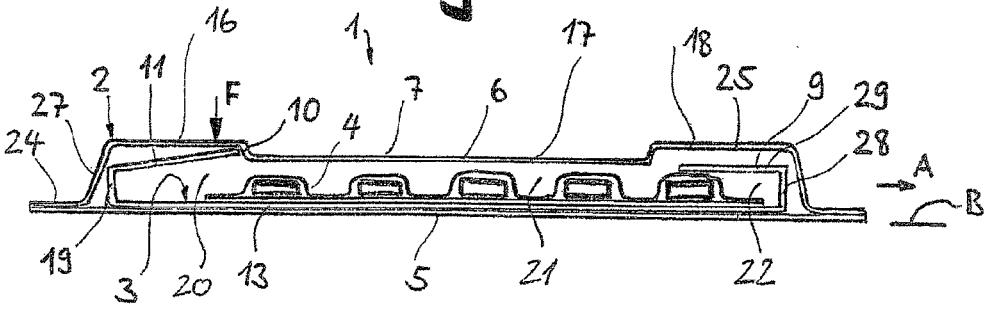
Figure 6:
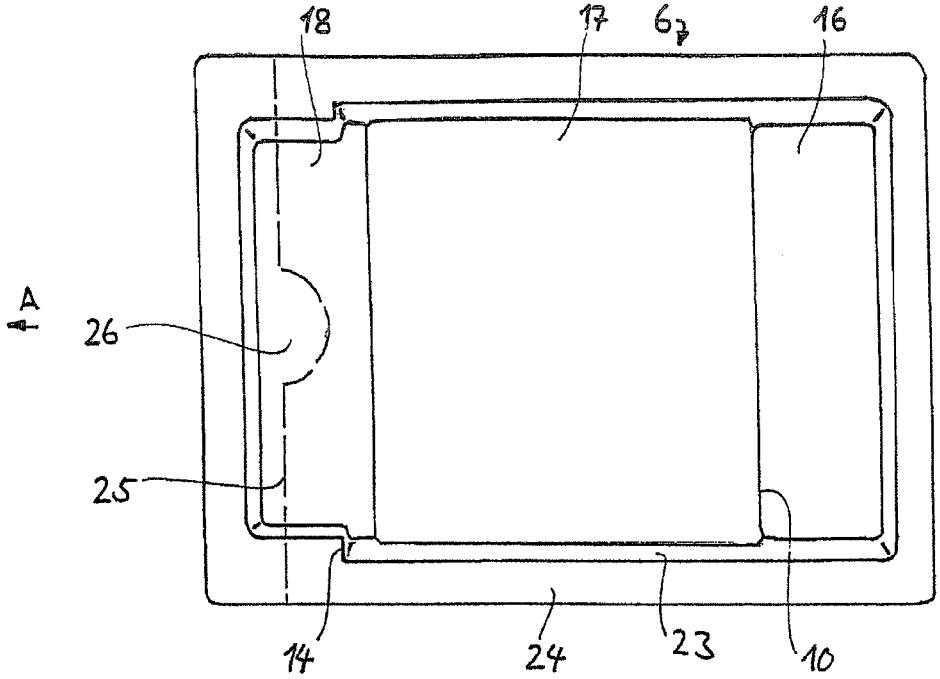
Figure 7:
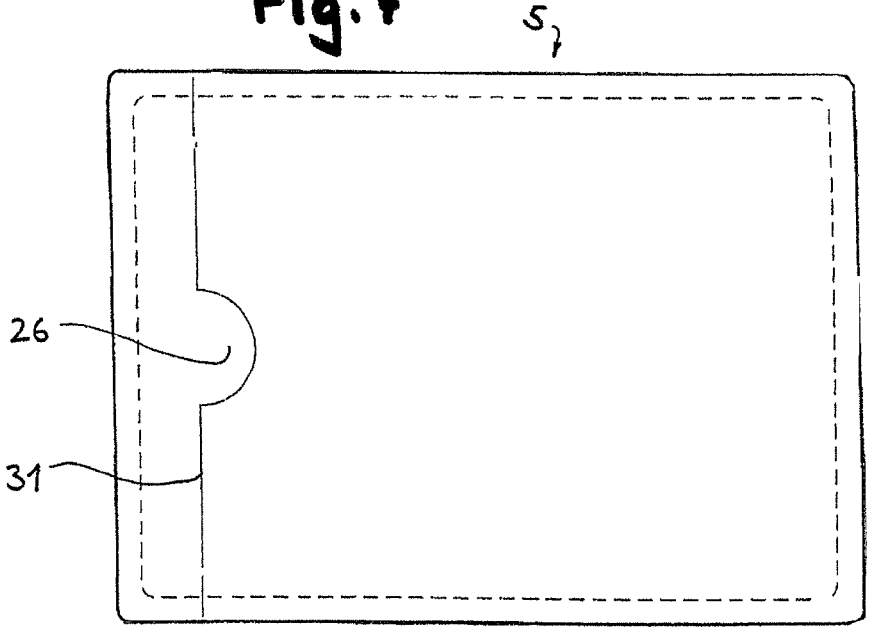
Figure 8:
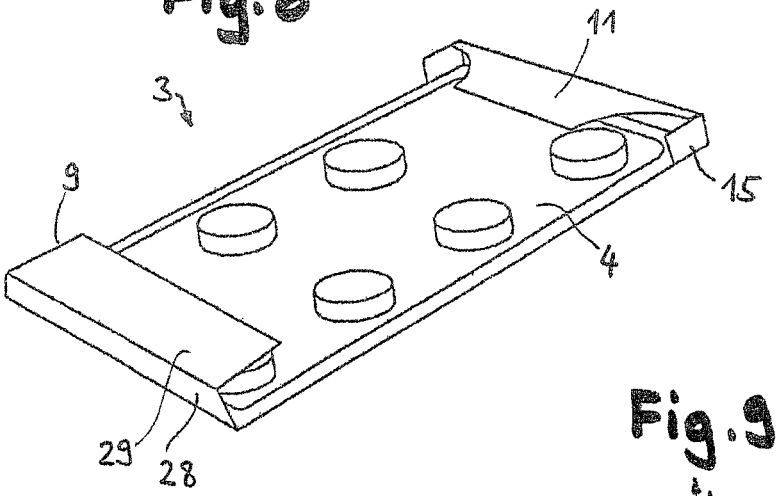
Figure 9:
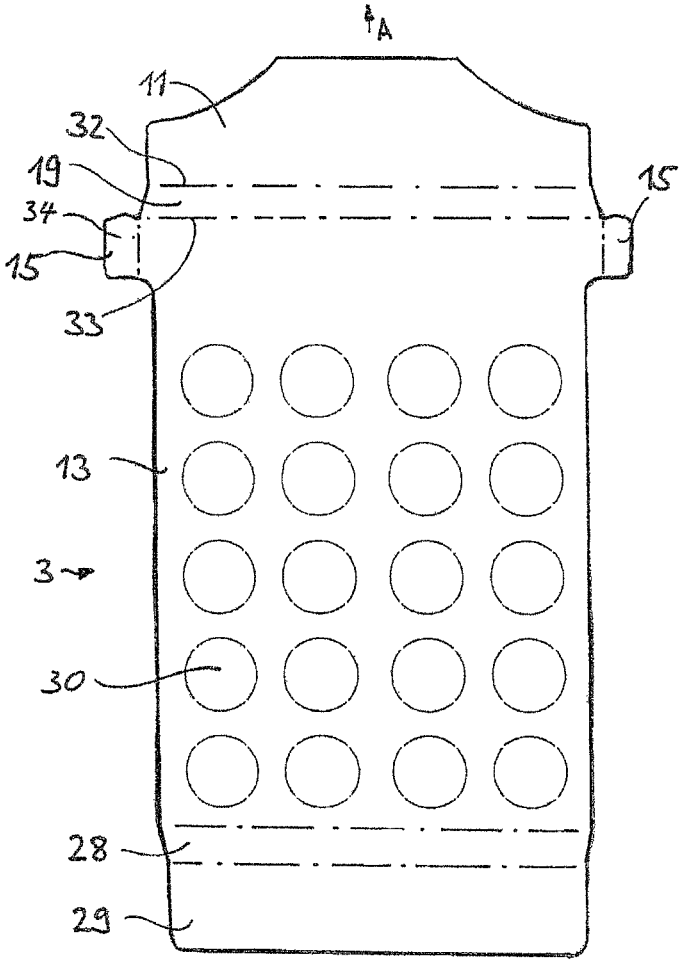
Figure 10:
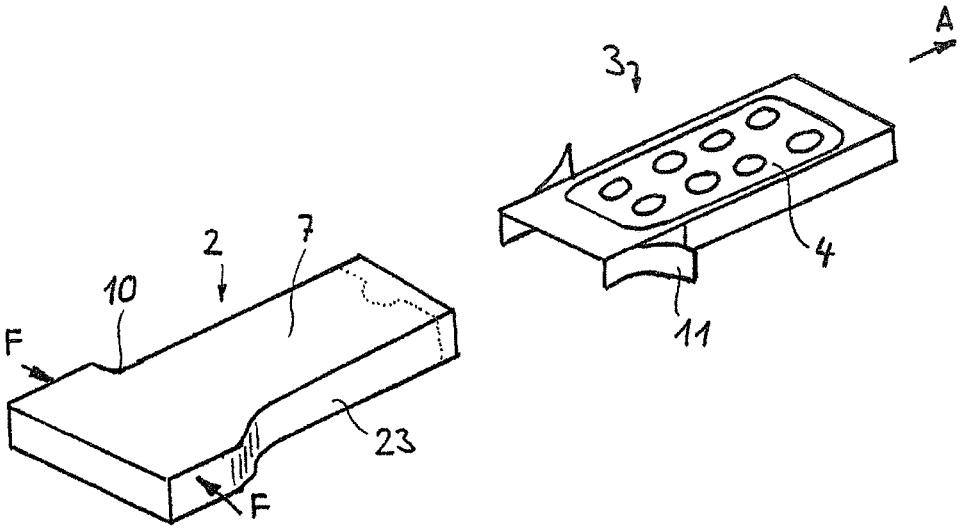

Further individual features and advantages of the invention can be gathered from the following description of the exemplary embodiments and from the drawings, in which:

FIG. 1 shows a perspective illustration of a pack according to the invention, FIG. 2 shows an exploded illustration of the pack according to FIG. 1, FIG. 3 shows the pack according to FIG. 1 following detachment of a closure, FIG. 4 shows the pack according to FIG. 3 with a blister carrier pulled out of a basic body, FIG. 5 shows a longitudinal section through the pack according to FIG. 1, FIG. 6 shows a plan view of the basic body of the pack according to FIG. 1, FIG. 7 shows a floor part for the pack according to FIG. 1, FIG. 8 shows a perspective illustration of the blister carrier, FIG. 9 shows a blank for the blister carrier of the pack according to FIG. 1, and FIG. 10 shows a perspective illustration of a pack according to a second exemplary embodiment.

FIG. 1 shows a pack which is designated 1 and is intended for packaging a blister (not illustrated here). The pack 1 contains a basic body 2 which predetermines an interior hollow. The basic body has a tray-like configuration which essentially forms the hollow, in which a blister carrier or some other carrier is, or can be, accommodated. This tray is enclosed by a peripheral portion 24, on which a sheet-like floor part, designated 5, is fastened. A floor plane, in which the floor part 5 runs in a sheet-like manner, is indicated by B.

The peripheral portion 24 is followed by side walls 23, 27 which project away from the floor plane B. The side walls contain two mutually opposite longitudinal side walls 23, which extend in the longitudinal direction A, and two transverse side walls 27. The side walls, finally, merge into a housing wall which forms the upper side 7 and is distinguished by a step-like configuration.

As FIG. 2 shows, the pack 1 comprises essentially three components, to be precise the floor part 5, a moulding 6 and the blister carrier 3, on which a blister 4 is fastened. Of course, the carrier 3 could also nevertheless be used for other purposes; it is not imperative for a blister to be fitted. The blister carrier 3 is produced from a single blank and contains a base portion 13 which is followed, on the two opposite end sides, by inwardly swung-in U-shaped ends. At the front end, the base portion 13 is followed by an articulation strip 28 which follows the base portion more or less vertically and, for its part, is followed by a further portion 29, which runs approximately parallel to the base portion. A latching tongue designated 11 can be seen in the region of the rear end side. This latching tongue 11 interacts with a latching shoulder 10, which is assigned to the moulding, in order to create a childproofing means. The precise functioning and the design of the childproofing means can be gathered hereinbelow with reference to FIG. 3 and, in particular, FIG. 5.

The pack 1 has a closure 8, which is an integral constituent part of the pack. The closure 8 is arranged at the end of the aforementioned end region and, by virtue of predetermined tearing lines 25 being provided, can be torn off from the rest of the pack.

In order for the pack to be opened for the first time, the user in the first instance has to push in a tongue 26, whereupon the closure 8 can be detached without any great amount of force being applied. A detached closure is designated 8' in FIG. 3. Such manipulation of the tongue is indicated by a curved arrow. Before the blister carrier can be pulled out of the basic body through the opening 12, the childproofing means of the pack has to be released. This takes place by pressure being applied to the basic body in the region of the rear housing-wall portion 16. This can be seen from FIG. 4. The pressure-exerting surface is indicated by a grey-coloured circular surface area and the displacement direction is indicated by the arrow A. The carrier 3 is prevented from being pulled all the way out by the blocking shoulders 14 in the moulding 6, these blocking shoulders interacting with the blocking segments 15 (FIG. 2) on the carrier.

The precise construction and the functioning of the pack are shown in a longitudinal section through the pack (FIG. 5). The upper side of the housing has a central wall portion 17 which is set back in relation to the adjacent wall portions 16 and 18. This gives rise to a step-like configuration of the housing wall, which divides the hollow up into three regions: a latching-tongue-accommodating region 20, which is predetermined by the housing-wall portion 16, a carrier-accommodating region 21, which is predetermined by the housing-wall portion 17, and an end region 22, which is predetermined by the housing-wall portion 18 (FIG. 5).

The inwardly swung-over latching tongue 11 is prestressed, and pushes upwards, on account of the material-induced restoring capability. This can ensure that the front edge of the latching tongue 11 engages with the latching shoulder 10. This interaction between the latching tongue 11 and latching shoulder 10 means that the blister carrier 3 is mounted in the basic body such that it cannot be pulled in direction A. The application of a pushing force F makes it possible for the housing-wall portion 18, and thus also the latching tongue 11, to be pushed downwards, as a result of which the engagement can be disabled and the blister carrier 3 can then be pulled out in direction A.

It can also clearly be seen from FIG. 5 that the moulding 6 has a tray-like configuration which is enclosed by the peripheral portion 24. As can be seen, the individual housing portions 16, 17, 18 run in a plane-parallel manner in relation to the floor plane B. An approximately U-shaped deflection 9 is located at the end assigned to the opening. The latching tongue 11 is located on the other end side. The moulding 6 is a comparatively thin-walled component which is produced by thermoforming or blow-moulding and is preferably made of a plastics sheet material (e.g. PE, PA, PVC or PPE).

FIGS. 6 and 7 each show plan views of the moulding 6 and of the floor part 5. The individual stepped portions running transversely to the longitudinal direction A in the housing wall which forms the upper side are clearly evident.

A border illustrated by a continuous dashed line can be seen in FIG. 7. This outer periphery forms an adhesive-bonding or sealing surface for fastening the moulding 6 on the floor part 5. 31 is used to indicate the predetermined tearing line which runs in the floor part 5.

As can be gathered from the illustration of the blister carrier according to FIG. 8, blocking segments, designated 15, are arranged on the same end side as the latching tongue, but on the sides.

As can be gathered from FIG. 9, the blister carrier 3, on which a blister 4 (not illustrated here) is fitted, may be produced from a single blank made of cardboard or cardboard laminate. FIG. 9 uses dashed lines to illustrate predetermined tearing lines (e.g. perforation lines) and chain-dotted lines to illustrate folding lines. The present blister carrier differs from the blister carrier according to previous FIGS. 2 and 3 merely in that this one is adapted for a different blister arrangement. In specific terms, the blister carrier 3 is provided for a 20-cavity blister or two 10-cavity blisters. The base portion has twenty securing segments 30 which are assigned to the push-through regions of the blister or blisters and are predetermined in each case by circular predetermined tearing lines. It is also possible, however, for the securing segments to be omitted and/or removal from the blister cavities can also be ensured by other means.

The laterally arranged blocking segments 15 are separated from the base portion by folding lines 34 running in the longitudinal direction A, and they can be swung inwards. The folding lines here may be predetermined in particular by rolled lines. The base portion 13 and the latching tongue 11 are separated from one another by an articulation strip 19 formed by folding lines 32, 33. It is clearly evident from the illustration according to FIG. 9 that the base portion 13 is broader in the rear region, which is directed towards the latching tongue 11, as a result of which, in practical terms, it is possible to rule out the situation where the blister carrier can be pulled all the way out of the pack. In theory, however, it would also be conceivable for the folding lines 34, which predetermine the articulation for the blocking segments 15, to adjoin the side edge directly or in a flush manner.

FIG. 10 shows a further variant of the pack, in the case of which the latching means, rather than being arranged in the region of the upper side, are arranged in the region of the transverse sides. In specific terms, FIG. 10 shows a basic body 2 which extends in direction A and has mutually opposite longitudinal side walls 23. Each longitudinal side wall 23 has a latching shoulder 10 which is predetermined by a tapered portion and predetermines a stop for the latching tongues 11 of the blister carrier 3 in the rest position. The present exemplary embodiment also differs from the previous exemplary embodiment in that the blister carrier 3 can also be pushed into the basic body 2, and latch thereto, only after the basic body 2 has been assembled.

The invention claimed is:

1. A pack comprising a basic body comprising a hollow; a carrier mounted in a displaceable manner in the hollow of the basic body in a rest position, the basic body and the carrier configured such that the carrier can be pulled at least part of the way out of the hollow of the basic body via an end opening of the basic body;

wherein securing means are provided such that the carrier can be pulled out of the hollow only by a specific application of force applied to the basic body, wherein the carrier comprises a latching tongue, which is articulated in a resilient manner on a base portion, and the basic body further comprises a housing wail with a latching shoulder, wherein the latching shoulder interacts with the latching tongue in order to create a latching connection in the rest position;

wherein the base portion and the latching tongue are separated from one another by an articulation strip, there being a first folding line between the base portion and the articulation strip and a second folding line between the articulation strip and the latching tongue;

wherein the base portion, the articulation strip, and the latching tongue, from a U-shape in side view when the carrier is in the rest position;

wherein the basic body comprises a two-part design comprising a floor part and a moulding;

wherein the basic body has a latching-tongue-accommodating for accommodating the latching tongue in the rest position, and in that the latching-tongue-accommodating region is followed in the direction of the a carrier-accommodating region, wherein the latching shoulder is located in the transition region between the latching-tongue-accommodating region and carrier-accommodating region; and wherein the carrier-accommodating region of the basic body is followed by an end region which predetermines the opening and accommodates a further U-shape of the carrier in the rest position, which U-shape is formed by a deflection of the carrier wherein a first portion of the housing wall, which is assigned to the end region, is elevated in relation to a second portion of the housing wall, which is assigned to the carrier-accommodating region.

2. The pack according to claim 1, wherein the carrier is a blister carrier for accommodating at least one blister.

3. The pack according to claim 1, wherein the latching shoulder is arranged on an upper side of the basic body, which is located opposite the carrier and extends in an approximately plane-parallel manner in relation to a floor plane.

4. The pack according to claim 1, wherein the latching shoulder is formed by a step in the housing wall.

5. The pack according to claim 1, wherein the second housing wall portion, which is assigned to the carrier-accommodating region, and a third portion of the housing wall, which is assigned to the latching-tongue-accommodating region, run in an approximately plane-parallel manner in relation to, a floor plane.

6. The pack according to claim 1, wherein the carrier comprises a blank made of cardboard or cardboard laminate.

7. The pack according to claim 1, wherein the housing wall can be pushed inwards in the latching-tongue-accommodating region in order to release the latching connection by elastic deformation and without any further weakening.

8. The pack according to claim 1, wherein the basic body has longitudinal side walls extending in the displacement direction, wherein, in order to delimit the displacement movement when the carrier is being pulled out, the side walls have a tapered portion which forms at least one stop for the latching tongue and/or other blocking means.

9. The pack according to claim 8, wherein the base portion has arranged on it in each case laterally articulated blocking segments which, when the carrier is being pulled out, can be made to strike against the tapered portion.

10. The pack according to claim 1, wherein the floor part is formed by a planar, sheet-like component which runs in a floor plane.

11. The pack according to claim 1, wherein the hollow is predetermined only by the shaping of the moulding.

12. The pack according to claim 1, wherein the floor part consists of paper, cardboard or a cardboard laminate.

13. The pack according to claim 1, wherein the moulding is a component produced by a moulding or forming operation and is made of plastics material.

14. The pack according to claim 1, wherein the moulding, for predetermining the hollow, has a tray-like configuration enclosed by a peripheral portion.

15. The pack according to claim 1, wherein the moulding has a peripheral portion which rests flat on the floor part and forms an adhesive-bonding or sealing surface.

16. The pack according to claim 1, wherein the end opening of the basic body is closed by a tear-off closure predetermined by predetermined tearing lines.

17. The pack according to claim 16, characterized in that the closure comprises parts both of the floor part and of the moulding.

18. The pack according to claim 12, wherein the moulding is produced by an injection-moulding or thermoforming method.

* * * * *